US009950716B2

(12) United States Patent
English et al.

(10) Patent No.: US 9,950,716 B2
(45) Date of Patent: Apr. 24, 2018

(54) AUTOMATED TRACK INSPECTION SYSTEM

(71) Applicant: Rail Pod Incorporated, Hull, MA (US)

(72) Inventors: Brendan English, Hull, MA (US); Paul Sandin, Brookline, NH (US); Blair Morad, Ipswich, MA (US); Shawn Dooley, Somerville, MA (US); Craig Thrall, Marshfield, MA (US)

( * ) Notice: Subject to any disclaimer, the term of this patent is extended or adjusted under 35 U.S.C. 154(b) by 243 days.

(21) Appl. No.: 14/755,070

(22) Filed: Jun. 30, 2015

(65) Prior Publication Data

US 2016/0002865 A1 Jan. 7, 2016

Related U.S. Application Data

(60) Provisional application No. 62/021,507, filed on Jul. 7, 2014.

(51) Int. Cl.
*B61K 9/08* (2006.01)

(52) U.S. Cl.
CPC ..... *B61K 9/08* (2013.01)

(58) Field of Classification Search
CPC ..... B61L 23/04; B61D 15/00; B61D 15/08; G01N 29/26; G01N 2291/2623; B61K 9/08
See application file for complete search history.

(56) References Cited

U.S. PATENT DOCUMENTS 4,468,966 A * 9/1984 Bradshaw ..... G01N 29/265 105/215.2
5,429,329 A * 7/1995 Wallace ..... B61L 23/041 246/121
5,623,244 A * 4/1997 Cooper ..... B61L 23/041 246/166
6,417,765 B1 * 7/2002 Capanna ..... B61L 23/041 246/166
8,260,574 B1 * 9/2012 Schuitema ..... B65G 43/02 198/571

(Continued)

OTHER PUBLICATIONS

Sundaram, Narayana and Sperry, Brian, Portable Track Loading Fixture Improvement, Research Results FRA Office of Railroad Policy & Development, RR Dec. 12-21, 2012, Washington, DC, www.fra.dot.gov/eLib/details/L04119.

*Primary Examiner* — Jason C Smith
(74) *Attorney, Agent, or Firm* — Clocktower Law; Erik J. Heels; Michael A. Bartley

(57) ABSTRACT

An autonomous device for rail track inspection includes a drive wheel system propelling the device via a drive wheel system, an automatic track loading fixture for and applying a load on rails, and sensors for taking track gauge measurement. Different automatic track loading fixtures may require stopping for load and measurement, or loading and measuring while still in motion. A switch agnostic system for operation with devices on a conventional railroad track system includes a linear slider movably mounted along a linear sliding support; multiple sensors mounted to the linear slider, the sensors operable to identify a rail of a track junction; and multiple roller bearings operable to engage the rail of the track junction and control the device across the track junction in response to movement of the linear slider along the linear sliding support.

17 Claims, 15 Drawing Sheets

(56) References Cited

U.S. PATENT DOCUMENTS

| | | | | |
|---|---|---|---|---|
| 8,720,345 | B1 * | 5/2014 | English | B61F 19/02 105/141 |
| 9,669,847 | B2 * | 6/2017 | English | B61F 19/02 |
| 2002/0065610 | A1 * | 5/2002 | Clark | B61D 15/00 702/35 |
| 2006/0000290 | A1 * | 1/2006 | Otto | B61K 9/08 73/798 |
| 2014/0069193 | A1 * | 3/2014 | Graham | G01N 29/04 73/584 |
| 2016/0002865 | A1 * | 1/2016 | English | B61K 9/08 356/72 |

* cited by examiner

AUTOMATED TRACK INSPECTION SYSTEM

CROSS-REFERENCE TO RELATED APPLICATIONS

This utility patent application claims priority from U.S. provisional patent application Ser. No. 62/021,507, filed Jul. 7, 2014, titled "AUTOMATED TRACK INSPECTION SYSTEM" naming inventors Brendan English, Paul Sandin, Blair Morad, Shawn Dooley, and Craig Thrall, which is hereby fully incorporated by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Copyright 2015, Rail Pod Incorporated.

BACKGROUND

Field of Technology

The present disclosure relates generally to track inspection, and, more specifically, to an automated track inspection system operable to autonomously provide geometry measurement inspection methods as well as autonomously navigate track junctions.

Description of Prior Art

The railroad track inspection market generally includes two major geometry measurement inspection methods. The methods include geometry measurements when the track is in an unloaded or loaded state.

Unloaded measurements refer to geometry measurements that are taken when the rails are not under the load of a locomotive or rail car. Unloaded measurements do not account for the weight of the locomotive or rail cars that physically spread the railroad gauge, cause rolling of the rails, and other geometric phenomenon when a load is applied. Loaded geometry measurements generally are taken when a locomotive, rail car, or simulated load is on the rails.

One way the railroad track inspection industry has attempted to increase the frequency of measuring loaded gauge is through the deployment of contact or optical sensors installed on existing rail cars or locomotives. However, because rail cars and locomotives typically are stored in rail yards for days at a time to load and unload goods, the associated sensors may be unavailable to measure gauge on a daily basis unless substantially every rail car and locomotive is equipped with such gauge measurement sensors.

When a locomotive or rail car is not available to generate a loaded state, load may be applied using various methods to include (1) a Portable Track Loading Fixture (PTLF), (2) a heavily weighted specialized track geometry measurement car, or (3) a split-axle loading mechanism to replicate the load. Loaded measurements facilitate identification or issues with the track that may not be identified through an unloaded measurement. Replicating the load of a train, however, is a costly effort that typically requires specialized equipment to efficiently collect these measurements in a short time period to minimize impact to revenue generating train operations.

The PTLF is a manually operated device that leverages a hydraulic piston to apply a lateral load replicating the lateral loads of a locomotive or rail car on the track. As a manual device, the PTLF is designed to conduct point measurements since it would be cost and time prohibitive to attempt manual measurement of loaded track geometry across an entire network of railroad infrastructure using a PTLF device on a regular basis. The PTLF device, however, requires a human to align the device, ensure the device is contacting the appropriate points on the rail, and to ensure that the device is not obstructed by other railroad track hardware such as spikes, spring clips, frogs, joint bars, and other equipment that could physically impede the proper use of the PTLF device.

Specialized track geometry cars replicate the load of a train through the use of ballast to simulate the weight of a train, or via a hydraulic split-axle mechanism that applies a horizontal and vertical load on the rails of a track. These specialized track geometry cars are relatively expensive to operate because a human is required to drive the vehicle along the rails, while an additional individual monitors the geometry measurements. As humans are physically present in the vehicle, rail operations are separated from train operations by a greater distance or time to ensure the safety of the human. These specialized vehicles may impose scheduling constraints on revenue train operations that may result in infrequent deployment. Additionally, split-axle systems have a tendency to result in a derailments due to the large lateral forces applied at the head of the rail causing delays in both inspection processes as well as revenue operations.

An alternative to specialized track geometry cars utilizes optical geometric measurement sensors, similar to those on specialized track geometry cars, on "revenue generating" trains. In the simplest of terms, a "revenue" rail car or locomotive contains optical geometric measurement sensors that collect loaded geometry measurements via the load of the train itself. The train is thereby generating revenue as it is also measuring geometry. However, because rail cars travel across various rail networks and spend a portion of time in rail yards loading and unloading goods, the availability of the rail car and associated sensors are restricted to the schedule of that rail car. In order to ensure frequent day-to-day inspection, the railroad would require widespread deployment of these sensors on a majority of the rail cars owned by the railroad, as well as the rail cars that are owned by other railroads that share track.

The manual operation of the PTLF device, the limited frequency of a specialized track geometry vehicle, and the otherwise extensive deployment of geometry sensors on revenue trains may impede railroad operators from conducting loaded gauge measurements on a desired frequent day-to-day basis.

BRIEF SUMMARY

Disclosed herein is a vehicle which deploys a track loading device referred to as an automatic track loading fixture ("ATLF") to replicate the lateral load of a railcar or locomotive while providing geometry measurement inspection methods, identifying common track obstructions that would interfere with the proper placement of the ATLF, and obviating the need for specialized track geometry cars that require human operation. This readily increases the frequency of loaded gauge measurements, avoids risks to humans who would otherwise be physically operating the specialized track geometry vehicle or utilizing the PTLF, and reduces interruption of revenue rail operations.

BRIEF DESCRIPTION OF THE DRAWINGS

In the drawings, closely related figures and items have the same number but different alphabetic suffixes. Processes, states, statuses, and databases are named for their respective functions.

DETAILED DESCRIPTION, INCLUDING THE PREFERRED EMBODIMENT

In the following detailed description, reference is made to the accompanying drawings which form a part hereof, and in which are shown, by way of illustration, specific embodiments which may be practiced. It is to be understood that other embodiments may be used, and structural changes may be made without departing from the scope of this disclosure.

Operation

Figure 1:
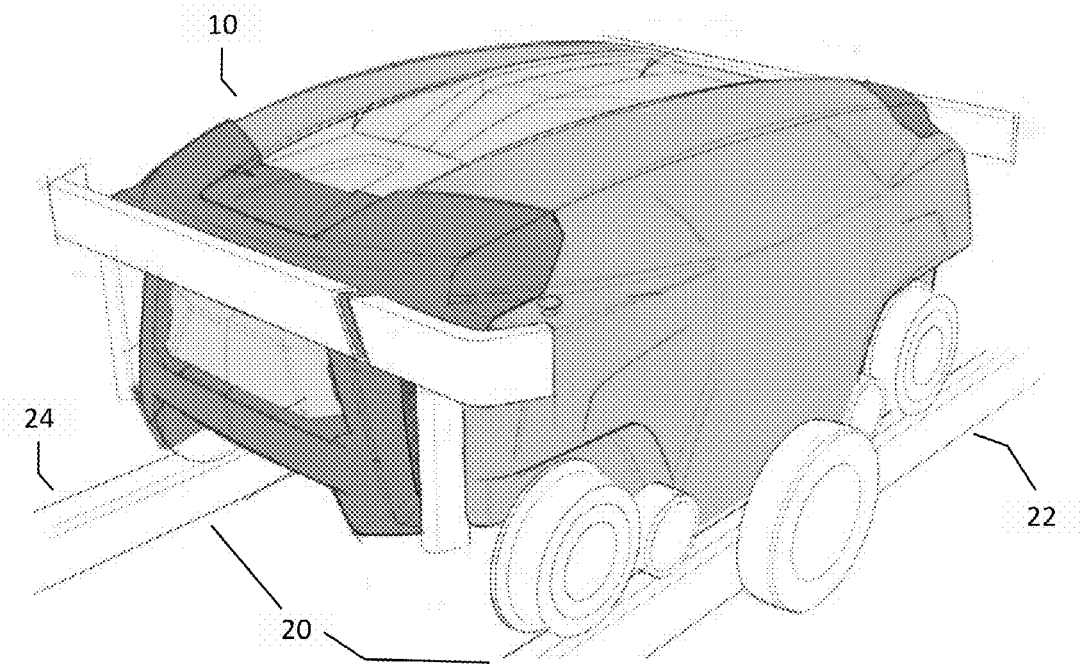
FIG. 1 is a perspective view of one example of a vehicle operable on a conventional rail system to provide track geometry measurements.

Referring to FIG. 1, vehicle 10 is configured for operation on conventional railroad track system 20. Conventional railroad track system 20 generally includes first rail 22 and second rail 24 supported in a spaced relationship. Vehicle 10, in this embodiment, is a robotic, self-propelled vehicle. Although depicted as a specific configuration, the concepts described herein are not limited to only such a configuration and the concepts and teachings may be applied to other configurations such as an outrigger configured vehicle, as well as various other vehicles such as robotic vehicles, hi-rail trucks, trains, cars, locomotives or any such device operable on railroad track system 20.

Figure 2:
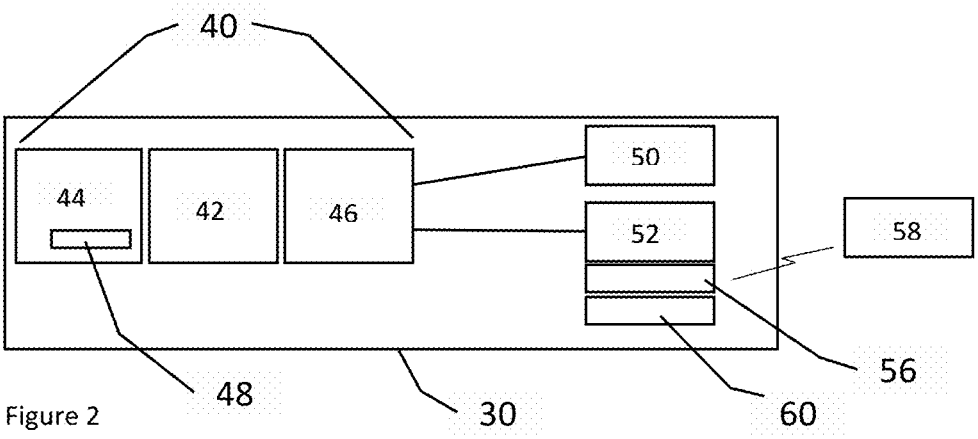
FIG. 2 is a schematic block diagram of a control system for the vehicle.

Referring also to FIG. 2, vehicle 10 is operable by control system 30. Control system 30 generally includes control module 40 with processor 42, memory 44, and interface 46. Although particular systems are separately defined, each or any of the systems may be otherwise combined or segregated via hardware and/or software.

Control module 40 may be a portion of a central vehicle control, a stand-alone unit, or other system such as a cloud-based system. Processor 42 may be any type of microprocessor having desired performance characteristics such that the microprocessor is able to process vehicle drive commands, switch agnostic commands, communication, and data collection tasks while operating the vehicle across the full speed range of zero to 100 MPH. Memory 44 may include any type of computer readable medium that stores data and control algorithms 48 described herein below. Other operational software for processor 42 may also be stored in memory 44. The functions of algorithm 48 are disclosed in terms of functional block diagrams and these functions may be implemented in either dedicated hardware circuitry or programmed software routines stored on a computer readable storage medium as instructions capable of execution on processor 42. That is, memory 44 is an example computer storage media having embodied thereon computer-executable instructions such as the algorithms that, when executed, perform a method of automated operation of vehicle 10.

Interface 46 facilitates communication with other systems such as sensor system 50, communication system 52, and other systems and/or devices. Communication system 52 may also include wireless communication system 56 that is operable to communicate with off board system 58. Off board system 58 may include, for example, a remote control system that permits remote operator control and communication with vehicle 10. Communication system 52 may further include positional system 60 such as a GPS device, inertial gyroscope, or accelerometers and is operable to accurately determine the location of vehicle 10.

Figure 9:
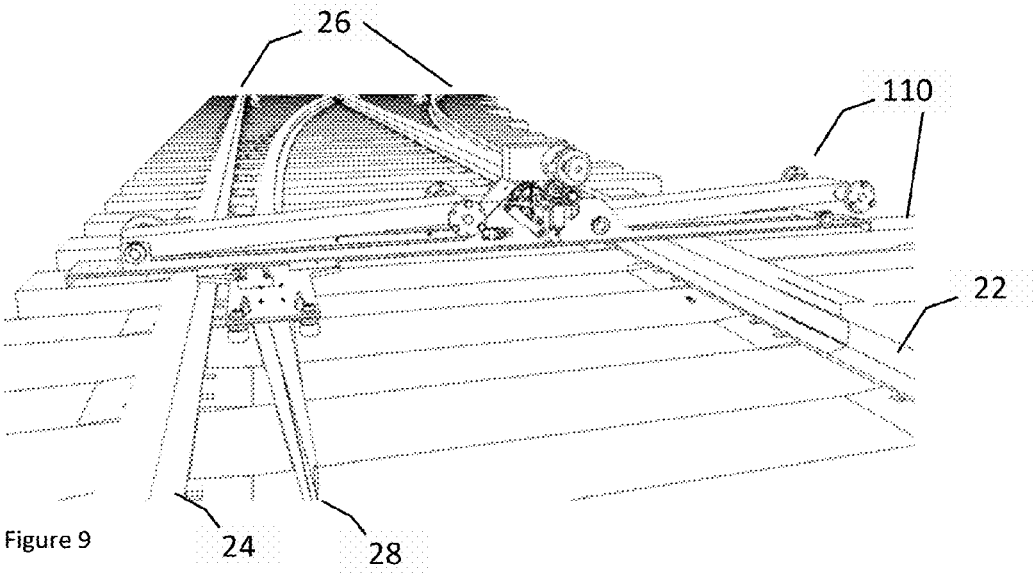
FIG. 9 is a perspective view of the switch agnostic system of FIG. 7 in a retracted position with respect to a point a of a railroad track system.

Positional system 60 is in communication with processor 42 and memory 44 to determine the position of vehicle 10 with respect to, for example, referring also to FIG. 9, track junction 26 such as a switch track, a frog, a point, a guard rail, a diamond, a crossing, or other area in which more than just two rails are present. The locations of track junctions 26, and a map of railroad track system 20 upon which vehicle 10 operates, may be stored in memory 44 to accurately locate vehicle 10 relative thereto such that vehicle 10 follows a desired preprogrammed or otherwise communicated path along railroad track system 20.

Figure 3:
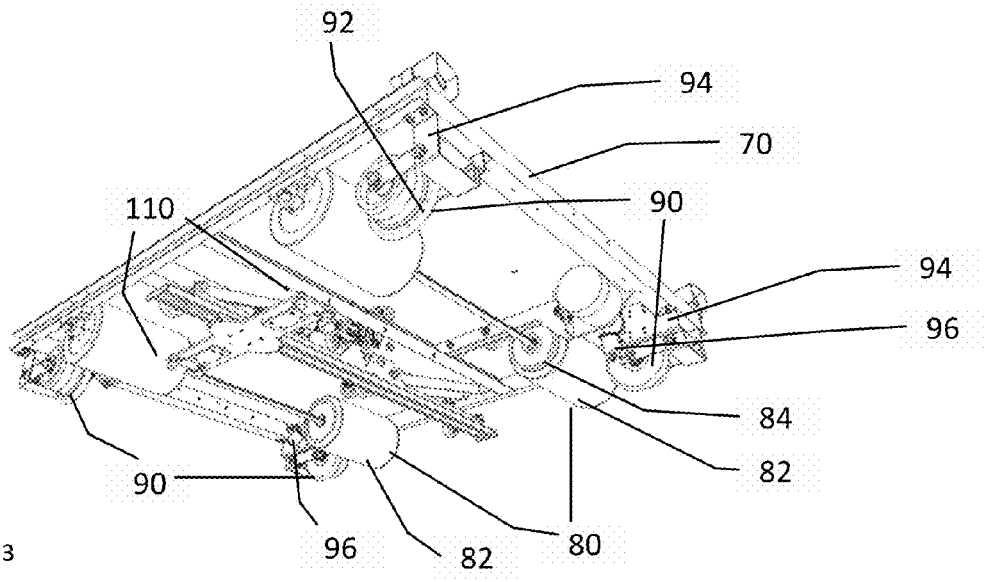
FIG. 3 is a bottom perspective view of a chassis for the vehicle of FIG. 1 with a switch agnostic system.
Figure 4:
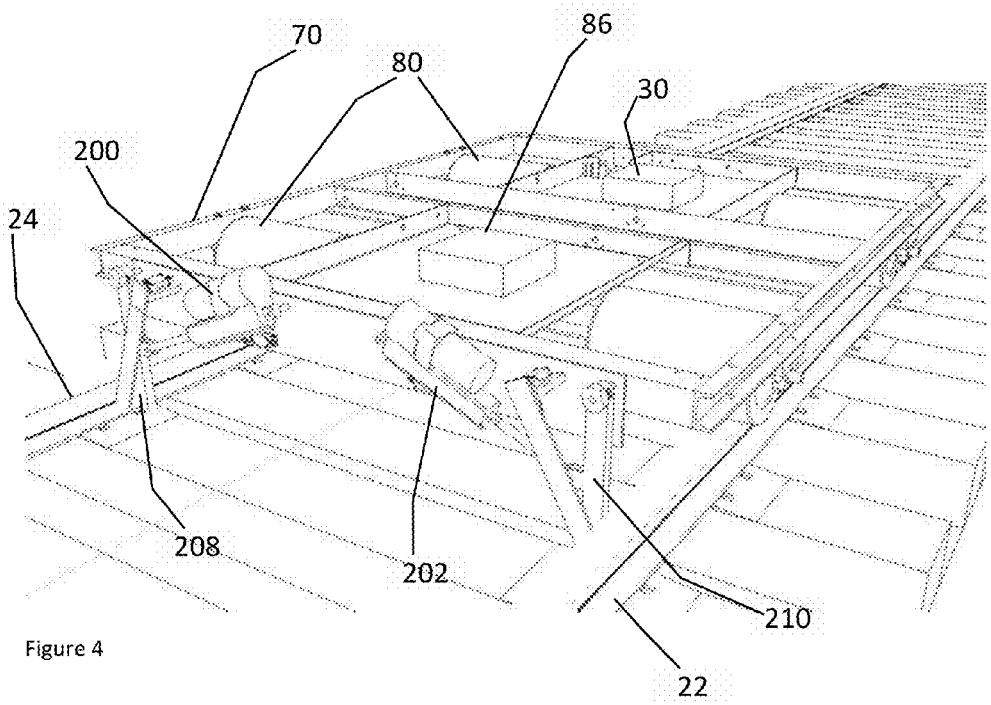
FIG. 4 is a perspective view of a chassis for the vehicle of FIG. 1 with a retractable Automatic Track Loading Fixture (ATLF).

Referring also to FIGS. 3 and 4, vehicle 10 generally includes control system 30, chassis 70, drive wheel system 80, guide wheel system 90, Automatic Track Loading Fixture (ATLF) 100, and switch agnostic system 110. Although particular systems are separately defined, each or any of the systems may be otherwise combined or segregated via hardware and/or software.

Drive wheel system 80 may include drive wheels 82 that include electric in-wheel motors 84, or separate motor and drive chain arrangements, powered by batteries 86 that can be charged at a station or via an on-board generator. Drive wheel system 80 may include, for example, two, four, or all wheel drive systems. Each of drive wheels 82 may further be of an extended width to facilitate traverse of track junction 26. In one embodiment, drive wheels 82 are wide enough to straddle rails 22 and 24 and a point (also referred to as "point rail", "switch rail", or "point blade") of track junction 26 of conventional railroad track system 20. That is, drive wheels 82 are wide so that the wheel can traverse the gap between the point and a fixed rail when the point is "open" (i.e. there is a gap between the fixed rail and the rail that moves in a switch).

Guide wheel system 90 may include flanged wheels 92 analogous to conventional train wheels that at least partially interface with an inner surface of rails 22 and 24 to provide guidance there along. In this embodiment, flanged wheels 92 are selectively retractable to clear railroad track system 20 in response to control module 40 as later described.

ATLF 100 is mounted to chassis 70 for selective deployment as controlled by control module 40. ATLF 100 is a track loading device that replicates the lateral load of a railcar or locomotive while measuring gauge and identifies common track obstructions that would interfere with proper placement. Various track loading devices may be mounted to chassis 70 to effectuate such measurements. ATLF 100 can also be applied to a variety of applications to include freight, transit, and commuter rail railroad tracks as well as in switching and industrial yards.

Figure 5:
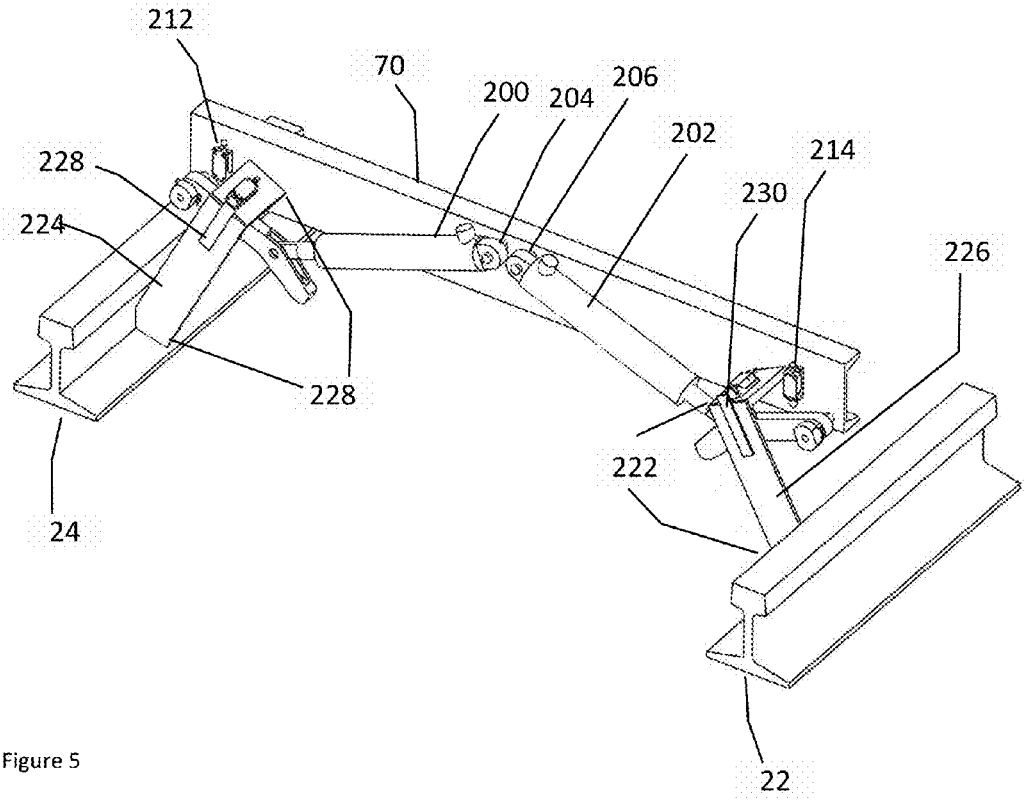
FIG. 5 is a perspective view of an embodiment of an Automatic Track Loading Fixture (ATLF).

Also referring to FIG. 5, one embodiment of the ATLF includes first actuator 200 and second actuator 202, such as hydraulic, pneumatic, or electric actuators, mounted to chassis 70 at respective pivots 204 and 206. Actuators 200 and 202 selectively extend respective rail loading arms 208 and 210 that apply a generally lateral load between rails 22 and 24. Rail loading arms 208 and 210 are operable to apply a consistent lateral load of, for example, an about 4000 lb. horizontal load. The ATLF provides a consistent lateral load whereas a train may apply inconsistent loads that may not facilitate accurate capture geometry measurements. Further, the ATLF applied load may also be readily adjusted based on, for example, the specific tolerances required for the class of track being measured.

Rail loading arms 208 and 210 selectively apply the load such that track geometry measurements may be performed under load by sensors 212 and 214 of sensor system 50. Sensors 212 and 214 are in communication with control module 40 via interface 46. Sensors 212 and 214 may include, but are not limited to, laser, sonar, radar, and other such distance and pressure sensors. In one embodiment, vehicle 10 is stopped for operation of the ATLF. In alternative embodiments, rail loading arms 208 and 210 may include a bearing, roller, wheel or other rolling interface to permit application of the load while vehicle 10 is moving.

Obstruction sensors 220 and 222 are mounted to chassis 70 forward of rail loading arms 208 and 210 to identify obstructions that may interfere with application of the track loading fixture. Obstruction sensors 220 and 222 may include paddles 224 and 226 of a flexible material, with sensor tabs 228 and 230 to measure deflection of paddles 224 and 226 that indicate if an obstruction would prevent appropriate contact of rail loading arms 208 and 210 with rails 22 and 24. Paddles 224 and 226 are sized and shaped to rub along a bottom flange and a web of rails 22 and 24. Alternatively, obstruction sensors 220 and 222 may include a hinged paddle, hinged or flexible wire/whiskers, a scanning laser, distance sensors, several fixed laser rangers, imagery sensors, or other. Sensor tabs 228 and 230 are in communication with control module 40 via the interface 46 such that vehicle 10 may be positioned to avoid the obstruction during the track geometry measurements.

Figure 6:
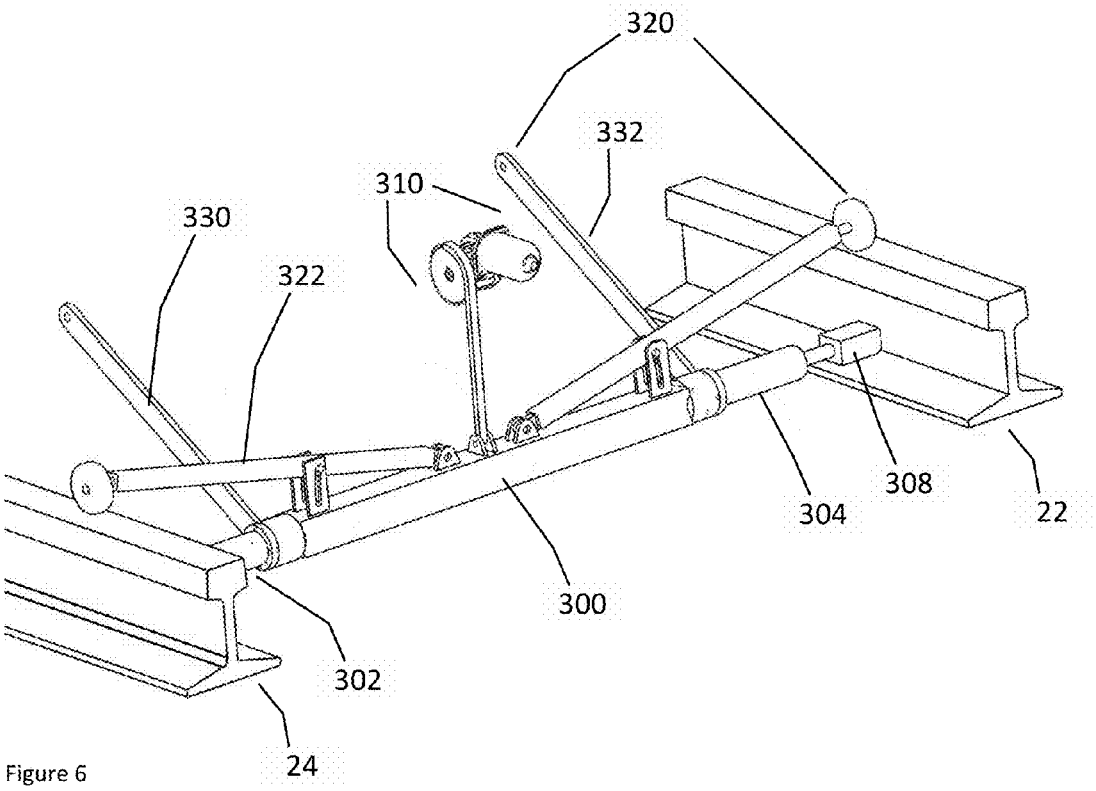
FIG. 6 is a perspective view of an alternative embodiment of an Automatic Track Loading Fixture (ATLF).

Referring also to FIG. 6, one embodiment of the ATLF includes single actuator 300 selectively locatable transverse to rails 22 and 24. Actuator 300 includes respective loading cylinders 302 and 304 that apply the load such that track geometry measurements may be performed under the desired load. Replaceable load pads 308 (similar pad attached to 302 hidden by rail 24) provide an interface with rails 22 and 24 and avoid slippage upon load application. Alternatively, load pads may include a bearing, roller, wheel or other rolling interface to permit application of the load while vehicle 10 is moving.

The ATLF is selectively vertically positioned to, for example, clear an obstruction. Lift system 310 is mouthed to chassis 70 to selectively vertically position ATLF 1008 via deployment and retraction of a belt, chain, or cable attached to actuator 300. Height control system 320 is pivotally mounted to actuator 300 to provide a desired height setting for actuator 300 to accommodate various types of railroad tracks with various web heights/dimensions and the type of train operating on the rail. Height control system 320 includes respective wheeled height control arms 322 and 324 that interface with a top surface of respective rails 22 and 24. Guide arms 330 and 332 are also pivotally mounted between the chassis and actuator 300 such that the lift system need only provide the motive force to vertically lift actuator 300.

Switch agnostic system 110 is mounted generally longitudinally centrally within chassis 70 between drive wheels 82 of drive wheel system 80 and flanged wheels 92 of guide wheel system 90. Flanged wheels 92 of guide wheel system 90 are located generally at each corner of chassis 70 outboard of drive wheels 82. Flanged wheels 92 are mounted to respective supports 94 such that flanged wheels 92 are selectively retractable and extendable via respective actuator 96, such as an electronic motor, in response to control module 40 via interface 46. That is, control module 40 deploys and retracts flanged wheels 92 of guide wheel system 90 as further described below.

Figure 7:
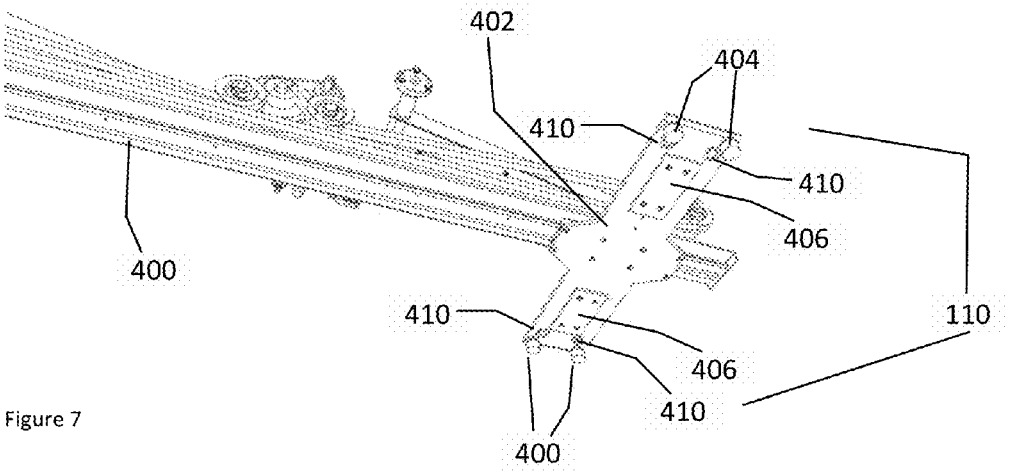
FIG. 7 is a bottom perspective view of a switch agnostic system.

Referring also to FIG. 7, switch agnostic system 110 generally includes linear sliding support 400 upon which linear slider 402 is positioned. The functionality of switch agnostic system 110 does not require the track to move for the vehicle to cross track junction 26. Linear sliding support 400 is arranged generally parallel to the axis of the drive wheels and linear slider 402 is generally perpendicular to linear sliding support 400. Linear slider 402 may alternatively or additionally permit rotational movement with respect to linear sliding support 400.

Linear slider 402 supports four roller bearings 404 spaced to receive a rail there between such that replaceable wear pads 406 on linear slider 402 slide along the top surface of one rail. That is, the chassis may be at least partially supported and thus guided thereby via linear slider 402 when switch agnostic system 110 is deployed.

Sensor 410, such as proximity sensor, is mounted to linear slider 402 generally proximate to each roller bearing 404. Sensors 410 (four shown) communicate with control module 40 via interface 46 such that control module 40 is operable to identify a rail or track junction 26 such as a point rail between rails 22 and 24. That is, sensors 410 are utilized to scan for track junction 26 when switch agnostic system 110 is retracted and/or deployed. Notably, the general position of vehicle 10 with respect to the track junction may be determined from a map of railroad track system 20 stored in memory 44 to initiate a more specific scan for the track junction via proximity sensors 410.

Figure 8:
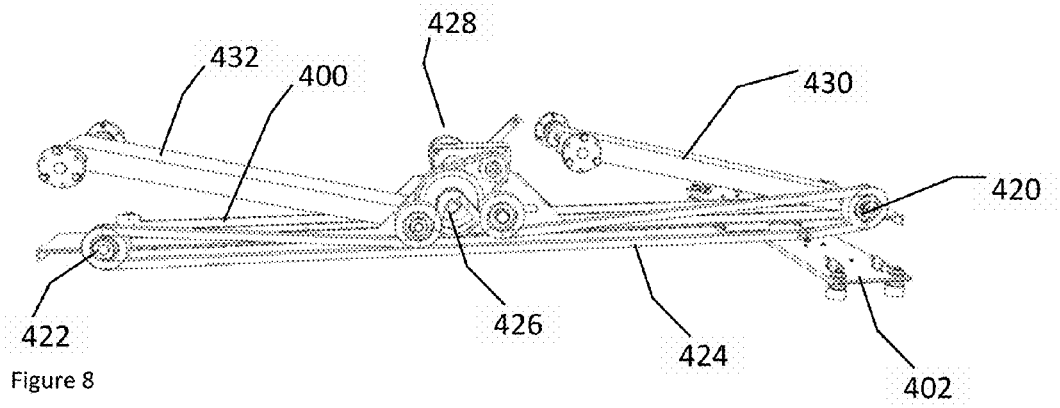
FIG. 8 is a side perspective view of the switch agnostic system of FIG. 7.

Referring also to FIG. 8, sprockets 420 and 422 are mounted adjacent each end section of linear sliding support 400. Chain 424 is connected to linear slider 402, engaged with sprockets 420 and 422. Sprockets 420 and 422 may be idler sprockets such that drive sprocket 426 powered by drive 428, such as an electric motor, selectively moves linear slider 402 along linear sliding support 400. That is, chain 424 is connected at one end to linear slider 402, engages sprocket 420, drive sprocket 426, sprocket 422, then again connected to linear slider 402. Various geared architectures and chain or belt arrangements as well as hydraulic actuators may be utilized between drive 428 and linear slider 402 to permit significant force generation such that the linear slider is operable to push/pull vehicle 10. That is, linear slider 402 is positioned along support rail 400 by drive 428. Control of drive 428 is effectuated by control module 40 via interface 46 to control movement of vehicle 10 when switch agnostic system 110 is deployed.

To deploy switch agnostic system 110, linear sliding support 400 is selectively lowered with respect to the chassis through pivot arms 430 and 432 that are pivotally mounted to linear sliding support 400 adjacent to sprockets 420 and 422. That is, linear sliding support 400 is selectively lowered and raised with respect to the chassis but remains generally parallel thereto.

Figure 10:
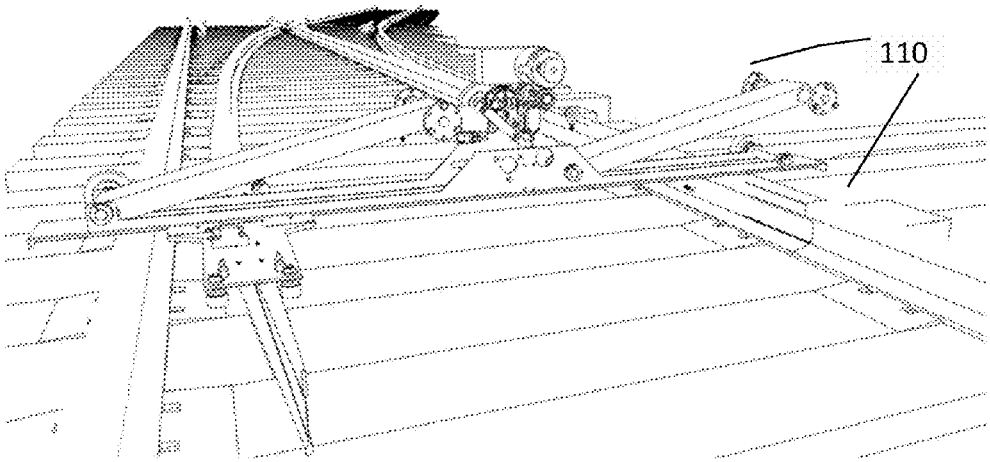
FIG. 10 is a perspective view of the switch agnostic system of FIG. 7 in a deployed position with respect to the point of a railroad track system.
Figure 11:
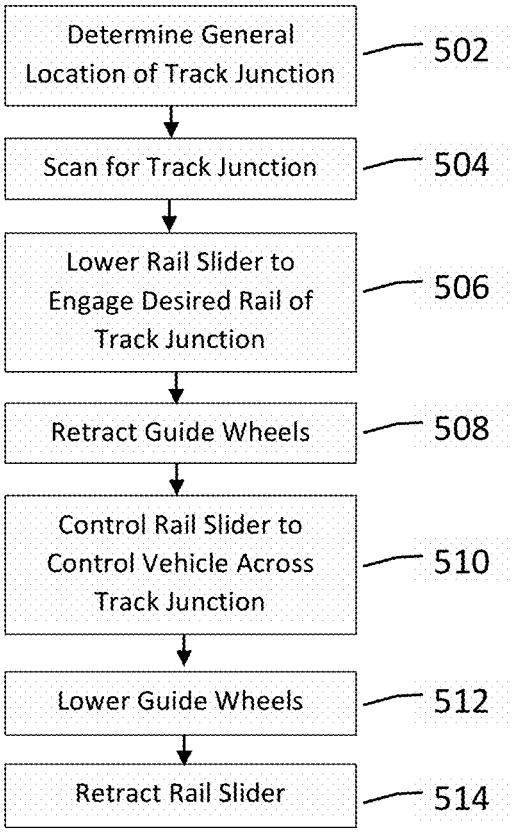
FIG. 11 is a flow chart illustrating operations of the vehicle switch agnostic unit of FIG. 7.

Referring also to FIG. 9, switch agnostic system 110 is shown in a retracted position with respect to example track junction 26, here shown with point rail 28 located between rails 22 and 24. Referring also to FIG. 10, switch agnostic system 110 is shown in an extended position. Referring also to FIG. 11, one embodiment of algorithms 48 for operation of vehicle 10 is schematically illustrated. The functions of the algorithm are disclosed in terms of functional block diagrams and these functions may be enacted in either dedicated hardware circuitry or programmed software routines as a computer readable storage medium capable of execution as instructions in a microprocessor based electronics control embodiment such as control system 26. That is, memory 44 is an example computer storage media having embodied thereon computer-useable instructions such as the algorithms that, when executed, performs the illustrated method of automated operation.

A method to autonomously switch a track upon which vehicle 10 operates initially utilizes a track database, such as that stored in memory 44, to provide 502 a general location of the track junction as vehicle 10 approaches. This map information is used to control drive wheel system 80 and slow vehicle 10 when approaching a track junction. Linear slider 402 "scans" 504 back and forth along support rail 400 to detect the specific track junction.

As vehicle 10 approaches the rail junction, as defined in the track database, linear slider 402 moves to a position on linear sliding support 400 while in a retracted position with proximity sensors 410 activated such that proximity sensors 410 determine if there is an object within the path of linear slider 402. Drive 428, such as through an encoder, determines the position of linear slider 402 such that linear slider 402 is synchronized with the proximity sensor signal and positioned to engage track junction 26.

After a track junction has been detected, switch agnostic system 110 is deployed so that linear slider 402 may engage 506 a desired rail of the track junction.

Once linear slider 402 is deployed onto the rail, linear slider 402 is locked into position so that linear slider 402 can shift entire vehicle 10 in the direction of the desired track junction switch.

Linear slider 402 at least partially supports and guides vehicle 10 such that flanged wheels 92 can be retracted 508 while drive wheels 82 provide the motive force to propel vehicle 10. That is, roller bearings 404 trap the rail there between such that replaceable wear pads 406 on linear slider 402 slide along the top surface of the rail to shift vehicle 10 in a push/pull manner. Drive 428 is thereby operable to move 510 linear slider 402, and thus vehicle 10, toward the desired direction of travel across the track junction. Drive wheels 82 are relatively wide to facilitate transition from one rail to another across the track junction.

As vehicle 10 moves forward through a track junction, eventually the point rail, in this example, becomes parallel with the opposite rail, also known as, "within gauge." Various sensors of sensor system 50, such as laser sensors, may be utilized to determine when the switch track/point is within gauge. Once the track is within gauge, guide wheel system 90 is lowered 512, then linear slider 402 is raised 514, and vehicle 10 readily continues along the track in the desired direction.

Figure 12:
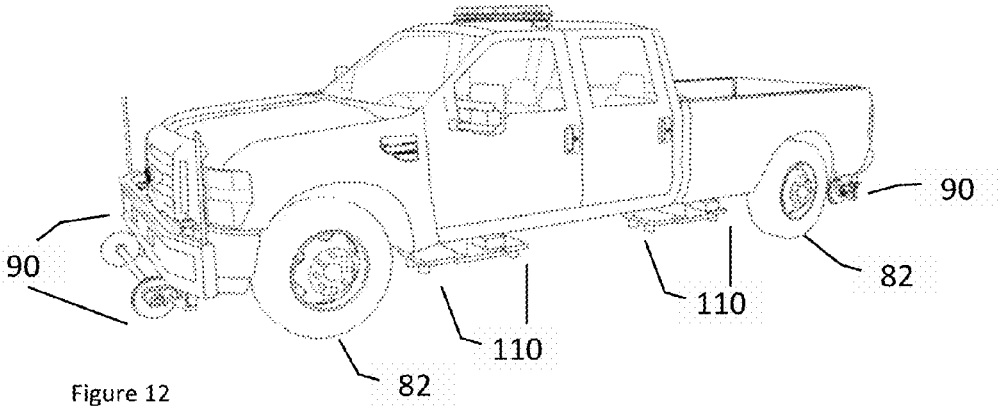
FIG. 12 is a side perspective view of a hi-rail vehicle with two switch agnostic systems.
Figure 13:
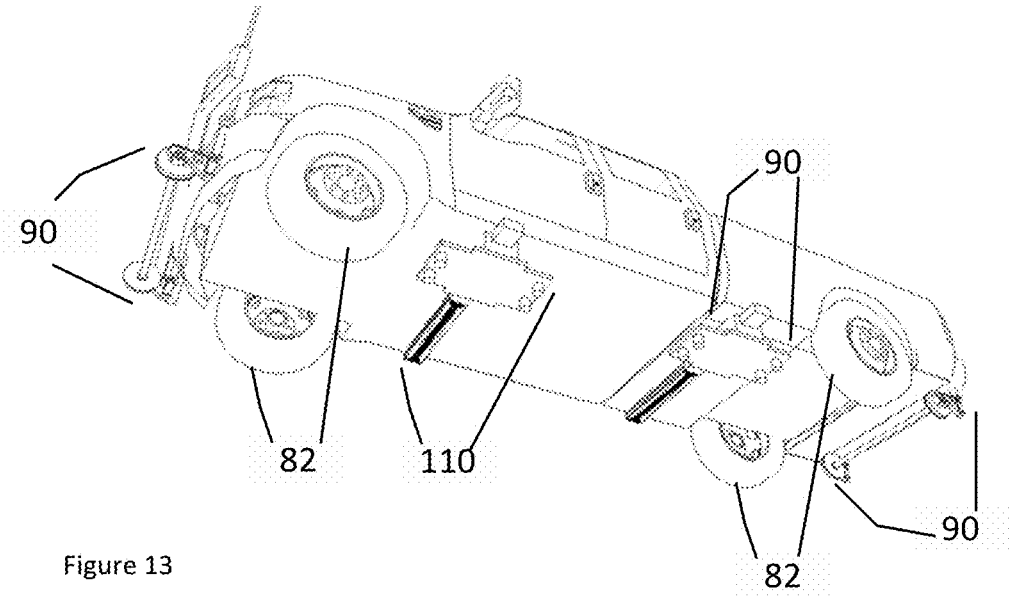
FIG. 13 is a bottom perspective view of the hi-rail vehicle of FIG. 21.

Also referring to FIGS. 12 and 13, in another embodiment, the vehicle is a hi-rail vehicle, for which drive wheels 82 are the vehicle tires and guide wheel system 90 are separately deployed and controlled, such as raised or lowered through hydraulic or pneumatic actuation. In this hi-rail vehicle embodiment, two switch agnostic systems 110 may be installed under the vehicle due to, for example, the length of the vehicle and to provide for balanced lifting of the hi-rail vehicle where for example the rear wheels would be raised, shifted, and lowered followed in series by the front wheels being raised, shifted and lowered as to ensure the entire hi-rail vehicle transitions through the switch. Alternatively, one relatively large switch agnostic system may be utilized. Switch agnostic systems 110 allows for a vehicle to be autonomously controlled, and/or permits an operator within a vehicle to traverse a track junction without requiring the operator or other individual to leave the vehicle to manually switch the track junction.

Other Embodiments

Figure 14:
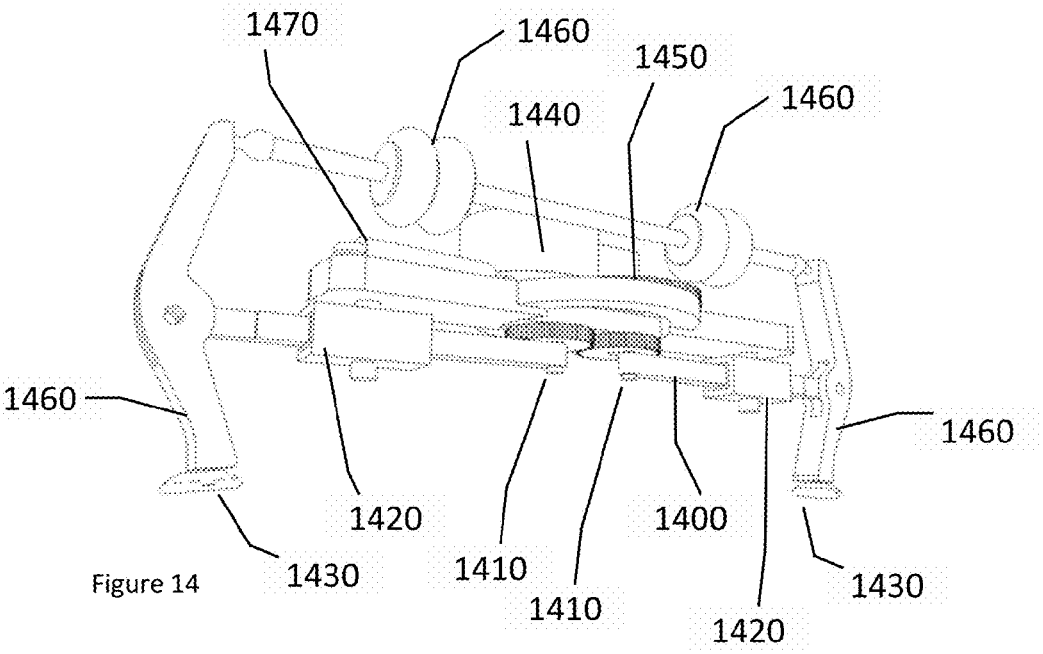
FIG. 14 is a front perspective view of an alternative embodiment of an Automatic Track Loading Fixture (ATLF).
Figure 15:
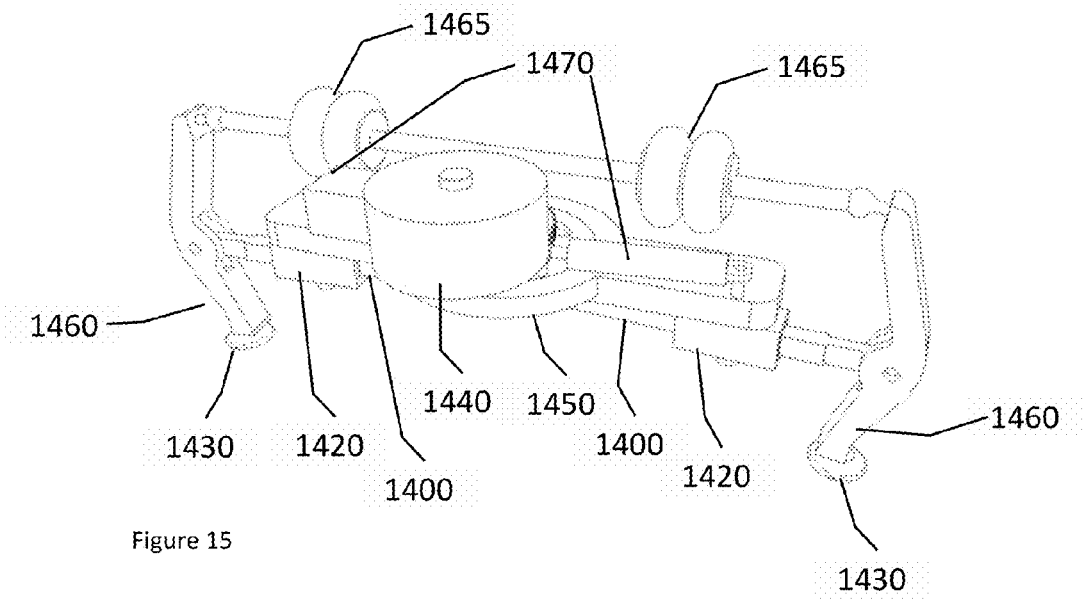
FIG. 15 is a back perspective view of the Automatic Track Loading Fixture (ATLF) of FIG. 14.

Referring also to FIGS. 14 and 15, an alternative embodiment of the ATLF uses a synchronized rowing mechanism to apply load, such as a 4000 lb load, across two parallel rails at the base/web fillet of the rails without stopping while traveling, and may be attached to vehicle 10 such as mounted on chassis 70. The ATLF may be attached in front, behind, or underneath vehicle 10. A set of arms or oars 1400 connect to cranks 1410. The oars pivot and slide through oarlocks 1420 resulting in a semi-cycloidal motion at the tip of the oars. In order to reach the desired loading point and incorporate load-limiting springs, the oars will act on feet 1430 tipped with small rollers. This mechanism produces the desired range and type of motion while driven by a smooth, continuously rotating drive system such as cadence motor 1440. The crank system is mounted on indexable turntable 1450 that can abruptly change the position of the cranks and thus retract the oars and feet from their working position whenever obstructions make loading impossible.

Bars or claws 1460 load the rail (such as rails 22, 24) in a lateral direction through contact at feet 1430.

The synchronized gears and related air/spring dampeners 1465 provide synchronous motion of the oars and claws so that claws 1460 contact the rail with generally even loads minimizing lateral vibrations. Cadence motor 1440 provides continuous rotation providing a consistent and repetitive motion of the claws providing a "short" throw (i.e. motion along the x-axis) that is restricted to an obstruction detection zone immediately adjacent to each rail. The entire motor assembly can be rotated about the center of the synchronized gears allowing for retraction actuator 1470 to rotate the entire motor, gearing, and oars 90 degrees allowing for further retraction of the claws towards the center point between the two rails. However, this motion retracts the claws into an area that may not be detectable by an obstruction detection system designed to detect obstructions immediately adjacent to each rail and may require a generally larger obstruction detection zone to support this extended range of motion on vehicle 10.

Cadence of the system is comprised of both a frequency and a phase. The frequency is driven by pulse rate of the binary obstruction detection system as it detects railroad tie fasteners. Due to the addition of random or repetitive obstructions (e.g. debris, joint bars), cadence control will identify the appropriate ATLF cadence or frequency. Phase of the system is driven by both the speed (e.g. 5 MPH or 10 MPH) and the distance between the loading points (e.g. 19.5 inches—the US standard for rail tie spacing on most freight railroads) and objects identified by the obstruction detection system.

The control system 30 operates and controls the ATLF in three general states to include a retracted state, a load cycling state, and a transition state. The retracted state consists of the entire ATLF system physically constrained three inches above the top plane of two parallel rails. This state is primarily used to determine a baseline rotation/cadence. The load cycling state operates the ATLF loading claws and related components. This cycles (loads and unloads the rails) and detects for obstructions. The transition state is the transition, in either direction, between the load cycling and retracted states.

For detecting distance between loading points (rail tie spacing), vehicle 10 may include an obstruction detection system. This system detects "non-navigable" obstructions that either preclude a measurement point or create a physical threat to the mechanism (in which case the ATLF mechanism will move to the retracted state to safely clear) and scans for clear sections of the rail (which will be used to establish the timing of load applications). Different obstruction detection systems may be utilized, such as a vision system or through use of laser profilers.

In an alternative embodiment, the ATLF may also include a method to ensure repeatable lateral movement of the rails only whereby the rail is held vertically stable while the lateral force is applied by the ATLF.

In an alternative embodiment, the ATLF may also apply lateral loads along one or multiple joints that connect two rails.

In an alternative embodiment, the ATLF may apply lateral loads within the general confines of a switch track to include the "point" and the "closure rails" whereby an appropriate load, for example 4000 lbs, is applied to ensure structural integrity of the point or closure rails.

In an alternative embodiment, the switch agnostic system may incorporate a method to utilize traditional flanged railroad wheels in place of wheel 82 whereby the flanged wheels raise and lower to transition over the point, closure rail, or other rail that is part of the railroad switch. These flanged wheels may combine characteristics of both a flanged wheel as well as characteristics of the illustrated cylindrical wheel 82.

ATLF 100 and/or switch agnostic system 110 may also be utilized with other hi-rail vehicles or light-weight vehicles sized to operate on rails.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different embodiments have specific illustrated components, the embodiments are not limited to those particular combinations. It is possible to use some of the components or features from any of the embodiments in combination with features or components from any of the other embodiments.

It should be appreciated that like reference numerals identify corresponding or similar elements throughout the several drawings. It should also be appreciated that although a particular component arrangement is disclosed in the illustrated embodiments, other arrangements will benefit herefrom.

It is to be understood that the above description is intended to be illustrative, and not restrictive. Many other embodiments will be apparent to those of skill in the art upon reviewing the above description. The scope of this disclosure should, therefore, be determined with reference to the appended claims, along with the full scope of equivalents to which such claims are entitled.

What is claimed is:

1. A device configured for operation on a conventional railroad track system, the device comprising:

a chassis;

a drive wheel system mounted to said chassis;

a guide wheel system mounted to said chassis;

a track loading device mounted to said chassis;

a control system operable to autonomously control said drive wheel system, said guide wheel system, and said track loading device; and a switch agnostic system mounted to said chassis, said switch agnostic system operable to engage a rail of a track junction and control the device across the track junction, and wherein said switch agnostic system and said guide wheel system are selectively movable between a retracted position and an extended position in response the control system.

2. The device of claim 1, wherein the switch agnostic system further comprises:

a linear sliding support rail;

a linear slider movably mounted along said linear sliding support;

multiple sensors mounted to said linear slider, said sensors operable to identify a rail of the track junction; and multiple roller bearings mounted to said linear slider, said roller bearings operable to engage rails of the track junction and control the device across the track junction in response to movement of the linear slider along said support rail.

3. The device of claim 2, wherein said linear sliding support is movable between a retracted position and an extended position.

4. The device of claim 2, further comprising a replaceable wear pad on said linear slider.

5. The device of claim 2, wherein said multiple roller bearings include four roller bearings with one roller bearing adjacent to each corner of said linear slider.

6. The device of claim 5, wherein said multiple sensors include four proximity sensors with one proximity sensor adjacent to each of the four roller bearings.

7. The device of claim 2, wherein said linear sliding support is parallel to an axis of said drive wheel system.

8. The device of claim 7, wherein said linear sliding support is between a first and a second axle of said drive wheel system.

9. The device of claim 2, wherein said drive wheel system includes a multiple of drive wheels, each of said multiple of drive wheels include an electric in-wheel motor.

10. A device configured for operation on a conventional railroad track system, the device comprising:

a chassis;

a drive wheel system mounted to said chassis;

a guide wheel system mounted to said chassis;

a track loading device mounted to said chassis;

a control system operable to autonomously control said drive wheel system, said guide wheel system, and said track loading device; and one or more obstruction sensors mounted to identify obstructions that may interfere with a track gauge measurement.

11. The device of claim 10, wherein said track loading device includes a first and a second actuator operable to selectively extend a respective rail loading arm to simultaneously apply a load to a first rail and to a second rail.

12. The device of claim 11, wherein said load is about 4000 lbs.

13. The device of claim 10, wherein said track loading device includes a single actuator vertically positionable between a first rail and a second rail to apply a load to the first rail and the second rail.

14. The device of claim 13, further comprising a height control system mounted to said single actuator to control the vertical position of said single actuator.

15. The device of claim 14, wherein said height control system includes a wheeled height control arm that interfaces with a top surface of a rail.

16. A device configured for operation on a conventional railroad track system, the device comprising:

a chassis;

a drive wheel system mounted to said chassis;

a guide wheel system mounted to said chassis;

a track loading device mounted to said chassis, wherein said track loading device comprises:

a pair of oars, each oar connected to a respective crank, a pair of rollers, one roller on the end of each oar, a pair of oarlocks, one oarlock on each oar, a pair of gears, each gear connected to one of the cranks, a cadence motor synchronously turning both gears, and a turntable connected to the cadence motor and cranks; and a control system operable to autonomously control said drive wheel system, said guide wheel system, and said track loading device.

17. The device of claim 16, further comprising an obstruction detection system for detecting obstruction and identifying rail tie spacing for cadence of load application.

* * * * *